US007209079B2

(12) United States Patent
Easton

(10) Patent No.: US 7,209,079 B2
(45) Date of Patent: Apr. 24, 2007

(54) BEAM STEERING APPARATUS

(75) Inventor: Nicholas J Easton, Chelmsford (GB)

(73) Assignee: BAE Systems plc, London (GB)

( * ) Notice: Subject to any disclaimer, the term of this patent is extended or adjusted under 35 U.S.C. 154(b) by 98 days.

(21) Appl. No.: 10/510,160

(22) PCT Filed: Sep. 8, 2004

(86) PCT No.: PCT/GB2004/003840

§ 371 (c)(1),
(2), (4) Date: Oct. 5, 2004

(87) PCT Pub. No.: WO2005/027266

PCT Pub. Date: Mar. 24, 2005

(65) Prior Publication Data

US 2006/0049984 A1 Mar. 9, 2006

(30) Foreign Application Priority Data

Sep. 12, 2003 (EP) ..... 03255736
Sep. 12, 2003 (GB) ..... 0321350.1

(51) Int. Cl.
*H01Q 3/22* (2006.01)

(52) U.S. Cl. ..... 342/375

(58) Field of Classification Search ..... 342/375
See application file for complete search history.

(56) References Cited

U.S. PATENT DOCUMENTS 4,736,463 A * 4/1988 Chavez ..... 342/367
5,103,495 A 4/1992 Goutzoulis
5,305,009 A * 4/1994 Goutzoulis et al. ..... 342/372
5,325,102 A * 6/1994 Page ..... 342/375
5,347,535 A * 9/1994 Karasawa et al. ..... 375/130
5,400,162 A * 3/1995 Newberg et al. ..... 398/168

(Continued)

FOREIGN PATENT DOCUMENTS

DE 199 56 351 5/2001

OTHER PUBLICATIONS

T.C. Cheston, Time-delay feed architectures for active scanned arrays, Antennas and Propagation Society International Symposium, vol. 3, p. 1620-1623, Jul. 1996.*

(Continued)

*Primary Examiner*—Thomas H. Tarcza
*Assistant Examiner*—F H Mull
(74) *Attorney, Agent, or Firm*—Nixon & Vanderhye P.C.

(57) ABSTRACT

A beam steering apparatus including an antenna array having a plurality of antenna elements. The antenna elements are spatially arranged with respect to one another and being operable to receive signals. A plurality of optical modulators, each of which is associated with a different one of the antenna elements and are operable to modulate signals received thereby onto a different respective optical carrier. A plurality of delay units for applying an amount of delay to modulated optical signals passing therethrough in respect of one or more of the antenna elements. A demultiplexer for separating the modulated optical carriers within an optical signal output by the delay units. A demodulator for demodulating the signal received by each antenna element from the respective separated modulated optical carrier. A combiner for combining the demodulated received signals output by the demodulator.

16 Claims, 4 Drawing Sheets

U.S. PATENT DOCUMENTS

| | | | | |
|---|---|---|---|---|
| 5,977,911 | A | 11/1999 | Green et al. | |
| 6,191,735 | B1 | 2/2001 | Schineller | |
| 6,426,721 | B1 * | 7/2002 | Obara | 342/375 |
| 5,414,433 | A | 5/1995 | Chang | |
| 5,721,556 | A | 2/1998 | Goutzoulis | |

OTHER PUBLICATIONS

N. Riza et al, "Phased-Array Antenna, Maximum-Compression, Reversible Photonic Beam Former With Ternary Designs and Multiple Wavelengths" *Applied Optics*, vol. 36, No. 5, Feb. 1997, pp. 983-996.

* cited by examiner

BEAM STEERING APPARATUS

This application is the US national phase of international application PCT/GB2004/003840 filed Sep. 8, 2004, which designated the US and claims priority to GB Application No. 0321350.1 filed 12 Sep. 2003 and EP Application No. 03255736.5 filed 12 Sep. 2003. The entire contents of these applications are incorporated herein by reference.

FIELD OF THE INVENTION

The present invention relates to beam steering apparatus and is suitable, particularly but not exclusively, for use with antennas arranged to transceive radio frequency signals.

BACKGROUND OF THE INVENTION

Many different signal processing systems are faced with the problem of capturing signals that emanate from different directions. Examples of such systems include Radio Frequency (RF) base stations, air traffic control systems, and satellite systems (to name a few), which either employ mechanical devices comprising an antenna that physically moves in space, or electronic devices comprising antenna elements that apply various phase shifts to incident signals, thereby effectively steering the incident signal. These electronic devices are commonly referred to as phased antenna arrays and are becoming more and more commonly used in RF sensor and communications systems because they do not involve physical motion of the antenna and are capable of moving a beam rapidly from one position to the next.

Phased arrays are conventionally implemented by applying a phase and amplitude weight to an element of an antenna array. By altering the phase slope applied across the array the pointing direction of the beam can be controlled. Alternatively a time delay is applied to an element of an antenna array; an advantage of applying time delays as opposed to a phase shift is that time is frequency independent, whereas phase is frequency dependent (for two different frequencies, the same amount of phase is equivalent to two different amounts of time and thus two different beam directions; if two signals of different frequencies are received and processed at the same time, this same amount of phase will result in the beams being steered in two different directions).

Antennas that are designed to instantaneously receive signals over a broad range of frequencies typically apply an amount of time to each element instead of an amount of phase, since this enables incident beams to be steered independently of their respective frequencies. Time delay systems essentially comprise time delay units having transmission lines of varying lengths and incoming signals are passed through various lengths in order to modify the direction of the beam. Conventional systems typically include digital devices that switch in these transmission lines, effectively adding discrete time delay "bits" to the beams. A problem with these systems is that the transmission lines occupy physical space, and, for a large array of antenna elements, many different lengths of transmission lines are required, which results in bulky and costly arrangements.

SUMMARY OF THE INVENTION

According to a first aspect of the present invention there is provided beam steering apparatus comprising:

an antenna array having a plurality of antenna elements, the antenna elements being spatially arranged with respect to one another and being operable to receive signals;

signal modulating means comprising a plurality of optical modulators, each of which is associated with a different one of the antenna elements and operable to modulate signals received thereby onto a different respective optical carrier;

delay means arranged to apply an amount of delay to modulated optical signals passing therethrough in respect of one or more of the antenna elements;

demultiplexing means operable to separate the modulated optical carriers within an optical signal output by the delay means;

demodulating means operable to demodulate the signal received by each antenna element from the respective separated modulated optical carrier; and combining means operable to combine the demodulated received signals output by the demodulating means, wherein the delay means comprise:

a plurality of first delay units, each of which is associated with a different one of the antenna elements and is operable to apply selectively either a first amount of delay or a second amount of delay to the respective modulated optical signal passing therethrough; and a plurality of second delay units, each of which is linked in series to at least one of the first delay units and is operable to apply selectively either a third amount of delay or a fourth amount of delay to modulated optical signals passing therethrough, and wherein at least one of said second delay units is connected in series to at least two of the first delay units.

Preferably, each optical carrier has a different frequency to that of the other carriers. This has the advantage that a number of different modulated optical carriers may pass through the same section of optical fibre without interference taking place between those carriers. Preferable the optical carriers are generated by lasers.

Thus in embodiments of the invention a given second delay unit is effectively re-used by a plurality of first delay units, which means that duplication of second delay units is minimised. Furthermore, different modulated optical carriers may be combined in a single optical fibre for input to a second delay unit that is linked to a number of first delays units so that each of the combined modulated optical carriers are delayed simultaneously, by a selected amount, without needing to separate the different modulated optical carriers.

In the event that the antenna array comprises a significant number of antenna units, and the delay circuitry comprises a corresponding significant number of first delay units, the delay circuitry preferably comprises further delay units arranged in series with the second delay units, and each further delay unit is connected to at least two second delay units. Thus this feature of re-use of time delay units is reproduced by each set of time delay units.

In one embodiment the delay circuitry is provided by a plurality of opto-electronic switches operable to route an optical signal through different lengths of fibre optic delay line to provide selectively the required amount of delay. Such opto-electronic switches may be arranged in series with one another, and a first difference between the first and second amounts of delay is different to a second difference between the third and fourth amounts of delay. In preferred arrangements the second difference is greater than the first difference, and the signals modified by the said at least two first delay units are combined prior to further modification by the second delay unit.

In preferred embodiments of the present invention optical fibre is used as the transmission medium. This has several advantages in comparison with the prior art use of cables to convey radio frequency signals through a series of delay circuits. In particular, in using optical fibre, signal losses and dispersion effects may be reduced and the resulting apparatus provides a physically compact and stable solution that is resistant to electro-magnetic interference. In this embodiment, signals modified by the first delay units are collected into the same waveguide prior to modification by the second delay unit, and are only combined into a single output signal after when the second time delay unit has applied the third or fourth amount of time delay and the resultant signals have been demultiplexed and demodulated. The beam steering apparatus comprises a demultiplexing device, preferably a wavelength division demultiplexing device, arranged to separate out the respective modulated carriers from the waveguide, and a demodulating unit arranged to demodulate the carriers from the optical domain into the radio frequency domain, at which point the signals are combined.

According to a second aspect of the present invention there is provided a method for combining signals received by antenna elements of an antenna array, the antenna array having a plurality of said antenna elements arranged spatially with respect to one another, the method comprising the steps of:

(i) for each antenna element of the array, modulating a signal received by the antenna element onto a different respective optical carrier, each said optical carrier having a different wavelength;

(ii) passing each of the modulated optical signals through first delaying means comprising a plurality of first delay units, a different one of said plurality of first delay units being provided in respect of each antenna element to apply selectively either a first or a second amount of delay to the respective modulated optical signal passing therethrough;

(iii) passing the modulated optical signals delayed by said first delaying means through second delaying means comprising a plurality of second delay units, wherein at least one of said second delay units is linked to at least two of said first delay units and the modulated optical signals output by said at least two of said first delay units are collected into the same optical waveguide for input to said at least one of said second delay units, each said second delay unit being arranged to apply selectively either a third or a fourth amount of delay to optical signals passing therethrough;

(iv) separating the delayed modulated optical carriers, output by the second delaying means, in a demultiplexer;

(v) demodulating the signal received by each of said antenna elements from the respective separated delayed modulated optical carrier; and (vi) combining the demodulated signals to output a combined signal as received by the antenna array.

Further features and advantages of the invention will become apparent from the following description of preferred embodiments of the invention, given by way of example only, which is made with reference to the accompanying drawings.

DETAILED DESCRIPTION OF THE INVENTION

Figure 1:
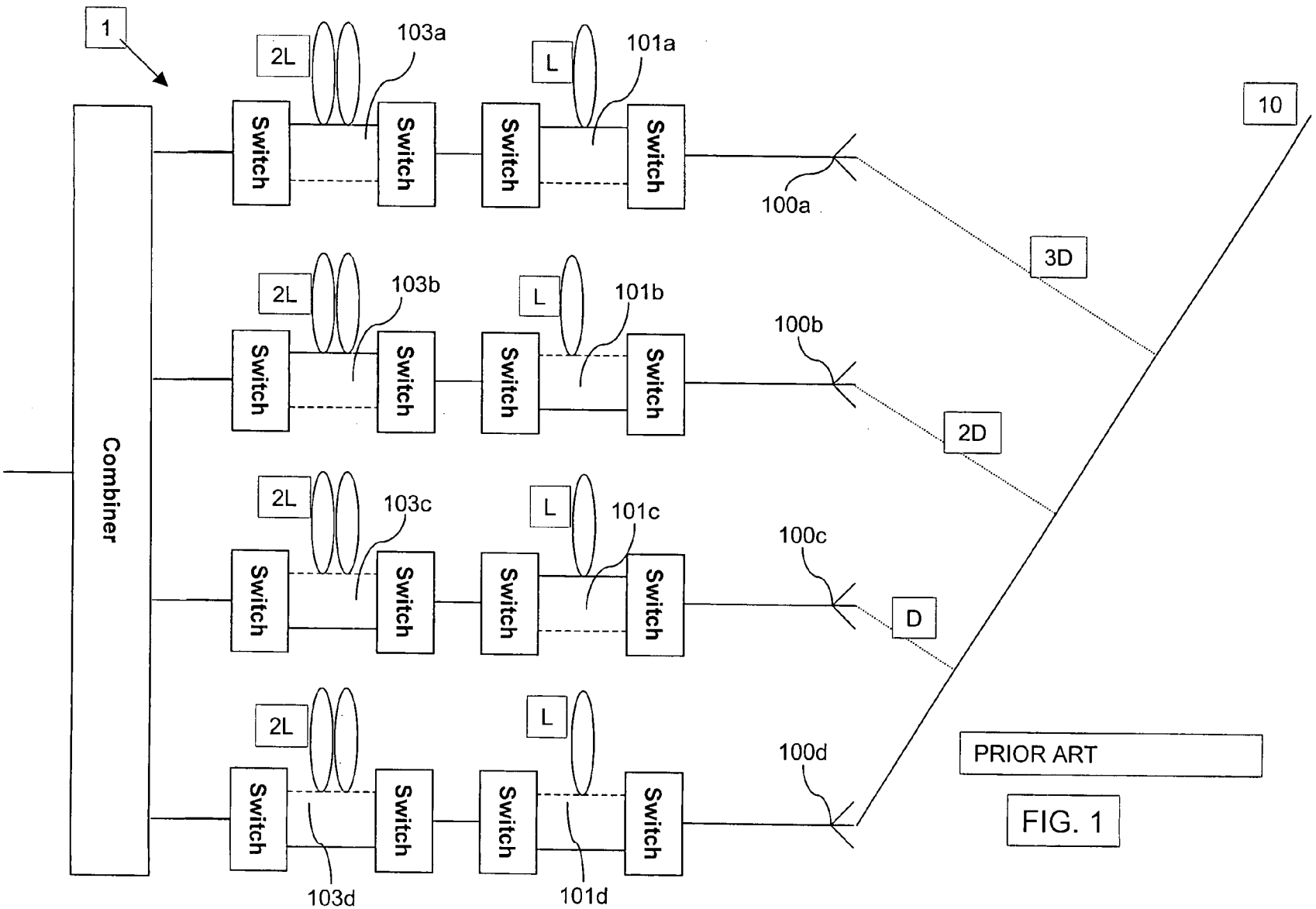
PRIOR ART FIG. 1
FIG. 1 is a schematic diagram showing a conventional phased antenna array.

FIG. 1 shows a wavefront 10 incident on a beam steering apparatus implemented as conventional phased antenna array 1. In such known arrangements the antenna array 1 comprises a plurality of antenna elements 100*a*, 100*b*, 100*c*, 100*d*, each of which is arranged to apply a certain amount of time delay to the part of the wavefront impinging thereon. The amount of time delay applied by each element is dependent on the shape of the wavefront and on the angle that the wavefront makes with respect to the antenna elements (referred to herein as direction of arrival of the wavefront); as can be seen from FIG. 1, different amounts of time delay are applied to each element, and the difference between the amounts of time delay applied by respective antenna elements is greatest between peripheral antenna elements 100*a*, 100*d*.

In this conventional arrangement, each antenna element 100*a*, 100*b*, 100*c*, 100*d* is connected to a plurality of delay units such 101*a*, 103*a* . . . 101*d*, 103*d* that are arranged in series. Note that the embodiment shown in FIG. 1 is illustrative only; in practice many more antenna elements will be used. When embodied as a two way switch, at any instant of time each delay unit is arranged to apply one of two amounts of time delay—here 0 and L for first delay units 101*a* . . . 101*d*, and 0 and 2 L for second delay units 103*a* . . . 103*d*. Thus, in this example the first and second amounts of delay are 0 and L and the third and fourth amounts of delay are 0 and 2 L respectively. It should be noted that the arrangement shown in the Figure is ideal since it implies that multiples of delay L compensate precisely for corresponding multiples of D.

In the Figure the signal path taken through a switch is indicated by a solid line. Thus in this example the incoming wave 10 is effectively steered by applying a delay of 0 to the wave received by antenna element 100*a*, by applying a delay of L to the wave received by antenna element 100*b*, by applying a delay of 2 L to the wave received by antenna element 100*c*, and by applying a delay of 3 L to the wave received by antenna element.

The degree of time delay control is dependent on the delay applied by the time delay units (here switches 101*a* . . . 103*d*), and selection of this degree of time delay control is dependent on a minimum acceptable quality of beam shape, which is governed by the maximum time delay error that can be suffered at each element. In the example shown in FIG. 1, the smallest amount of time delay that can be applied is L, so the antenna array 1 can compensate for the direction of arrival of the wavefront with an accuracy of 1 L.

It will be appreciated that, as the angle between the wavefront and the antenna elements 100*a* . . . 100*d* increases, the difference between the amounts of time delay applied at peripheral antenna elements 100*a*, 100*d* has to increase correspondingly. Furthermore, if the wavefront is to be steered at various positions along its length, the antenna array 1 will have to comprise many time delay units in series with one another, which means that the antenna array 1 can be quite large and complex. Moreover, if fine-tuning of the time delay control is required (meaning that the amount of delay (L) applied by the first time delay units 101*a* . . . 101*d* is small), even more delay units will be required.

Figure 2:
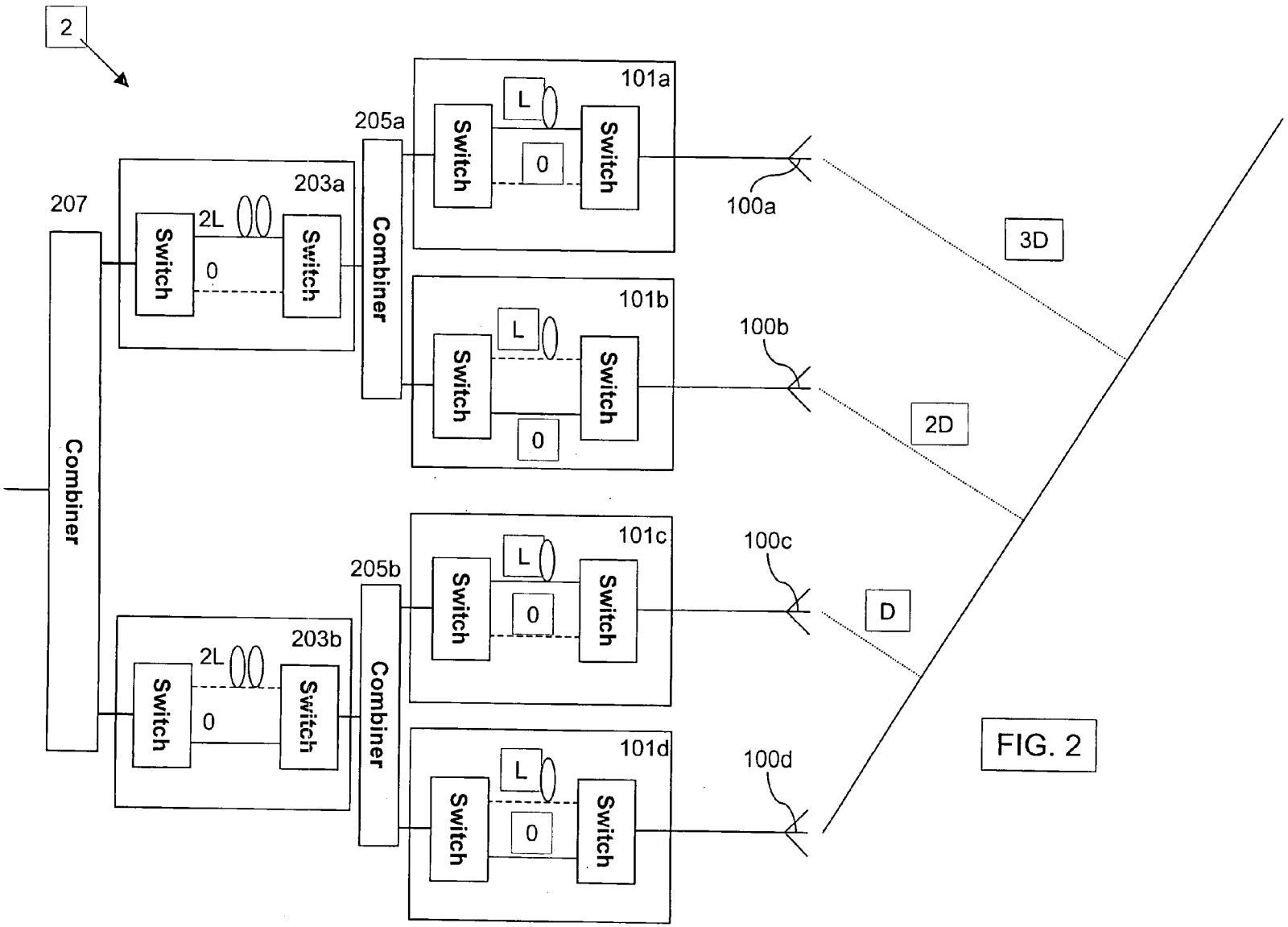
FIG. 2 is a schematic diagram showing a first embodiment of a beamformer according to the invention.
Figure 3:
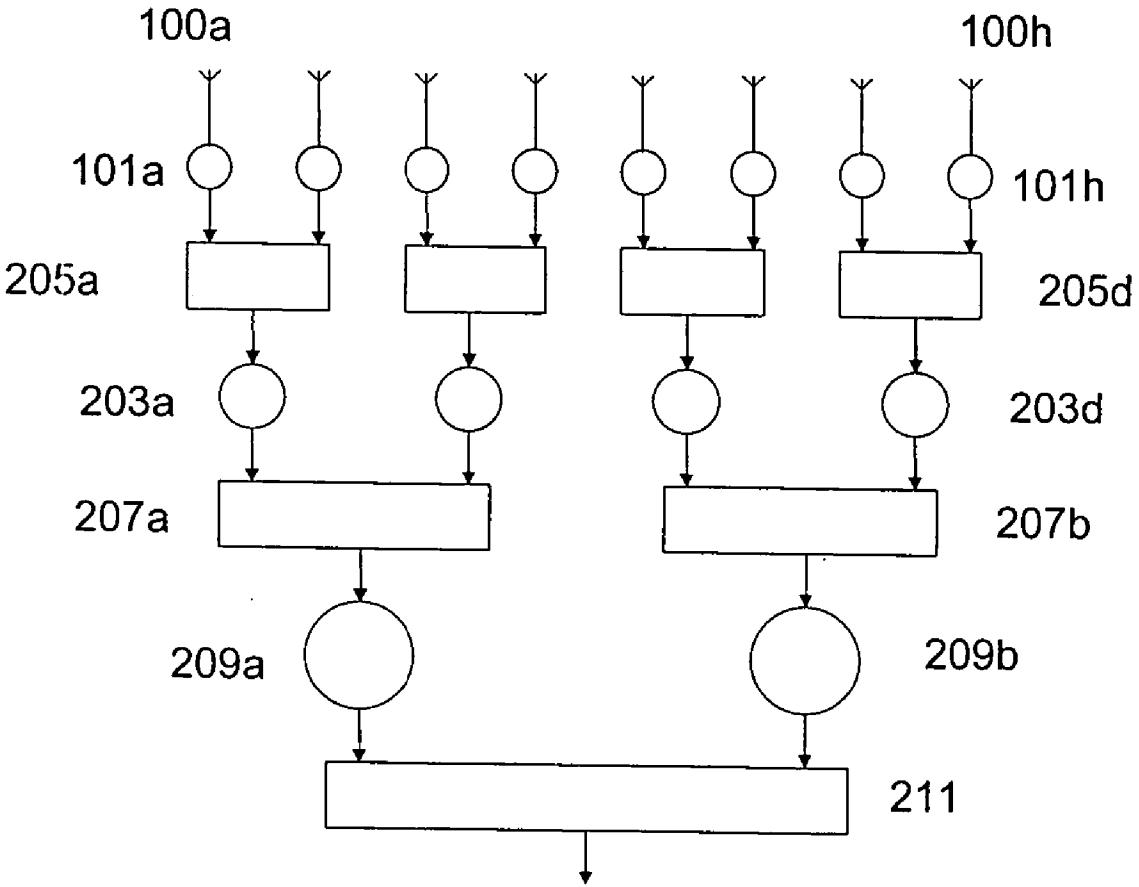
FIG. 3 is a schematic diagram showing an alternative arrangement of the beamformer of FIG. 2.

Embodiments of beam steering apparatus according to the invention will now be described with reference to FIGS. 2 and 3. Turning firstly to FIG. 2, in a first embodiment of the invention, referred to herein as a beamformer, the beamformer 2 comprises a plurality of first delay units 101*a* . . .

101*d*, each of which is arranged to apply an amount of time delay to signals transceived by a respective antenna element, and a plurality of second delay units 203*a*, 203*b*, each of which is arranged to apply an amount of time delay to signals that have been modified by the first delay units 101*a* . . . 101*d*. At least one 203*a*, and preferably both 203*a*, 203*b*, of the second units are connected to two first delay units 101*a*, 101*b* via a combiner unit 205*a*, 205*b*, which, in the case of combiner unit 205*a*, is arranged to combine signals that have been modified by the associated first delay units 101*a*, 101*b*, and in the case of combiner unit 205*b*, is arranged to combine signals that have been modified by the associated first delay units 101*c*, 101*d*. Preferably the combiner units 205*a*, 205*b* sum the modified signals, and pass them onto the second delay units 203*a*, 203*b*, which proceed to apply a further delay to the signals. These further modified signals are then combined in another combiner unit 207, summing the further delayed signals.

Turning again to FIG. 1, it can be seen that when the antenna array 1 is applying 0, L, 2 L and 3 L delay to signals transceived at respective antenna elements 100*a* . . . 100*d*, second switches 103*a*, 103*b* assume the same switch position as one another (in this example 2 L), and second switches 103*c*, 103*d* assume the same switch position as one another (in this example 0). By use of the present invention, the duplication of delay units is reduced, which means that the antenna array includes fewer delay units. As a result, antenna arrays can be produced according to the invention, which are less bulky, complex and costly than those currently utilized.

In the example shown in FIG. 2, there are only four antenna elements, and, since the first delay units 101*a* . . . 101*d* are embodied as two-way switches (meaning that each combiner unit 205*a*, 205*b* receives input from two first units), the beamformer 2 only comprises two levels of delay units. However, in practical embodiments of the invention, beamformers comprise a significantly greater number of antenna elements, which means that the number of levels of delay units will increase accordingly. FIG. 3 shows an example where the beamformer comprises eight antenna elements 100*a* . . . 100*h*, three levels of delay units (101*a* . . . 101*h*, 203*a* . . . 203*d*, 209*a* and 209*b*) and a further combiner unit 211. The improved efficiency, in terms of reduction of duplicated delay units (and corresponding re-use or "sharing" of amounts of delay) can be readily appreciated with increasing numbers of antenna elements and amounts of delay required.

In one embodiment the signals are passed between delay units 101*a* . . . 101*d*, 103*a* . . . 103*d* and combiner units 205*a*, 205*b* via cables. However, in a further embodiment the transmission medium used is optical fibre, in order to reduce relative losses and dispersion effects, and to provide a physically compact and stable solution that is resistant to electromagnetic interference.

Figure 4:
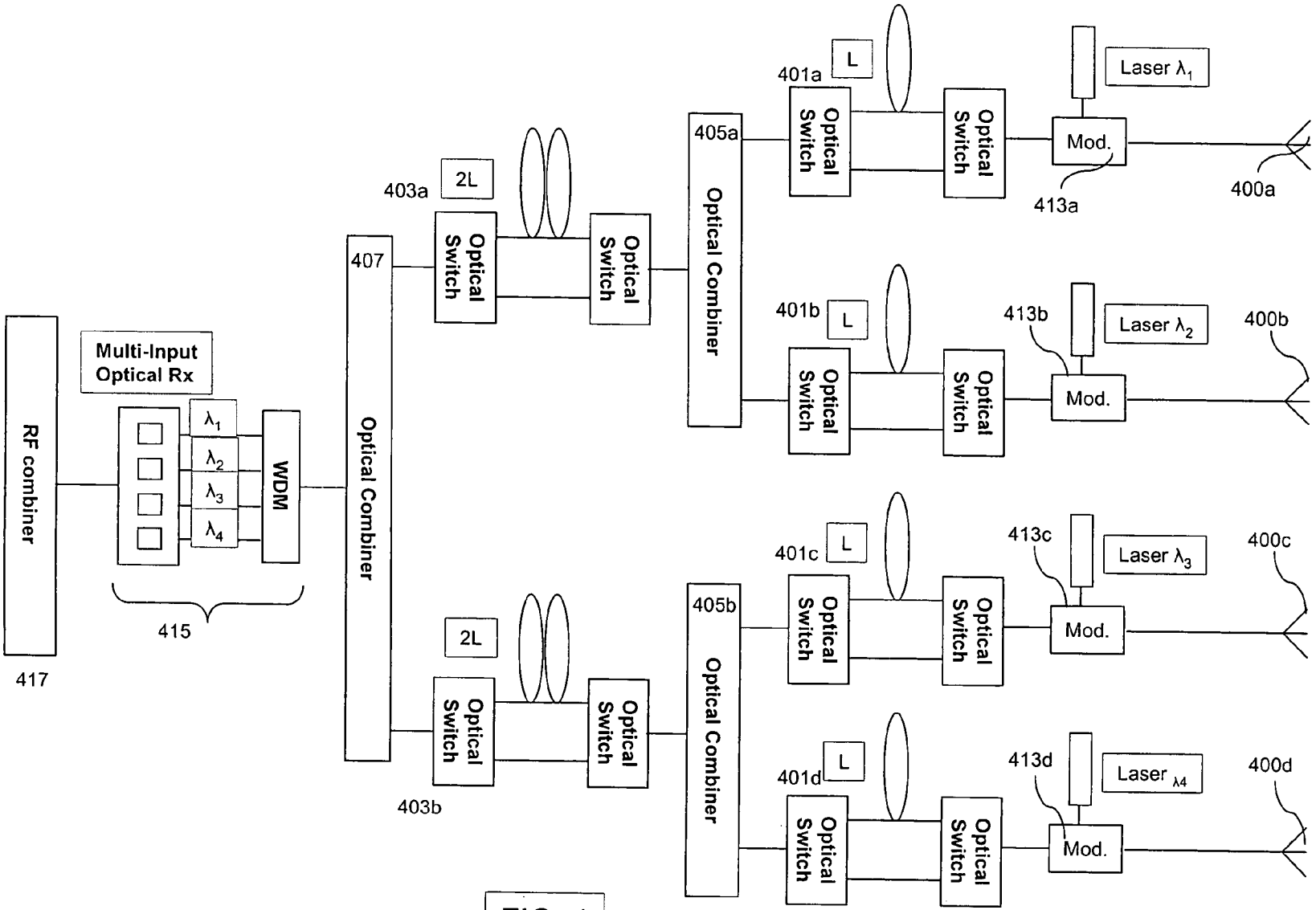
FIG. 4 is a schematic diagram showing a second embodiment of a beamformer according to the invention.

FIG. 4 shows a further embodiment of the beam steering apparatus according to the present invention. Transceived Radio Frequency (RF) signals are in this embodiment modulated onto an optical carrier by laser devices 413*a* . . . 413*d*, and the (first and subsequent) delay units 401*a* . . . 401*d*, 403*a* . . . 403*d*, etc. are preferably embodied in Opto Electronic Integrated Circuits (OEIC). Each transceived signal is modulated onto an optical carrier having a wavelength, for example, in the 1300 nm or in the 1550 nm band.

The summation of signals performed by respective combiner units 405*a*, 405*b*, 407 etc. can be performed in the optical domain, but more preferably is performed in the RF domain because RF signals have a far longer wavelength (thus more relaxed accuracy requirements) than that of optical carriers. In one arrangement the signals can be summed, as described above with reference to FIGS. 2 and 3, at each combiner unit, which involves demodulating and re-modulating the RF signals from their respective carriers at each combiner unit (meaning that the combiner units will require the corresponding modulating and demodulating capabilities). Preferably, however, the signals are merely collected by combiner units 405*a*, 405*b* in the optical domain and are only summed when the collected signals have been separated out and demodulated into the RF domain. This means that only one device is required to have demodulating capabilities.

Accordingly, in this arrangement each transceived signal is modulated onto an optical carrier of a different wavelength, and each combiner unit 205*a*, 205*b*, 207 etc. is arranged to input signals received from its associated first units 101*a*, 101*b* into the same waveguide. Wavelengths in the 1300 nm and 1550 nm bands can be used, and the wavelengths are spaced apart so that there is no interference between the carriers (e.g. spacing between 0.1 nm and 14 nm can be used). The combined signals pass through the next and, if relevant, successive delay units 403*a*, 403*b* as described above with reference to FIG. 2, with identical time delays being applied to those wavelengths passing through the same delay unit. The beamformer 2 may also comprise a final combiner 407 and a conventional wavelength demultiplexing device 415 that is arranged to demultiplex the wavelengths at the output using conventional wavelength demultiplexing techniques. These demultiplexed signals can then be demodulated and summed in the RF domain using a suitable device, shown as part 417.

Whilst in the above embodiments the time delay units are two-way switches, they could alternatively be switches comprising three or more switching paths. In this case, the combiner units can be arranged to receive input from a corresponding three or more first units.

Whilst in the second embodiment the delay units are provided by OEIC, they could alternatively be provided by suitable mechanical switches.

Whilst in the above embodiments the entire beamformer is shown to be configured in accordance with the invention, the hierarchical arrangement of first delay units and second delay units could alternatively be applied to a selected part of the beamformer.

Whilst in the above embodiments the delay unit arrangement includes one switchable delay unit at each node, the arrangement could alternatively comprise a plurality of two-way switchable delay units arranged in series at each node in at least the highest level nodes of the hierarchy (the antenna element level.) Each such a series would consist of delay units having progressively smaller time delay differences between their two respective settings (e.g. L, L/2, L/4, etc.), whereby a variety of time delays may be applied at selected increments (e.g. L/4) at each element. Thus, a variety of beam steering angles may be achieved by selecting appropriate settings for each of the switches in each of the series.

Whilst in the above embodiments the combiner units 205*a* . . . 205*d*, 207*a*, etc. are shown to be separate from respective second delay units 203*a* . . . 203*d*, 209*a*, 209*b*, they could alternatively be an integral part of the second delay units.

Whilst in the Figures the antenna elements 100*a* . . . 100*d* are shown spaced in a linear array, they could alternatively be spaced in a circular array or a planar array.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. Beam steering apparatus comprising:

an antenna array having a plurality of antenna elements, the antenna elements being spatially arranged with respect to one another and being operable to receive signals;

signal modulating means for modulating signals received by said antenna elements onto different respective optical carriers, said signal modulating means comprising a plurality of optical modulators, each of which is associated with a different one of the antenna elements;

delay means for applying an amount of delay to modulated optical signals passing therethrough in respect of at least one of the antenna elements;

demultiplexing means for separating the modulated optical carriers within an optical signal output by the delay means;

demodulating means for demodulating the signal received by each antenna element from the respective separated modulated optical carrier; and combining means for combining the demodulated received signals output by the demodulating means, wherein the delay means comprises:

a plurality of first delay units, each of which is associated with a different one of the antenna elements and is operable to apply selectively either a first amount of delay or a second amount of delay to the respective modulated optical signal passing therethrough; and a plurality of second delay units, each of which is linked in series to at least one of the first delay units and is operable to apply selectively either a third amount of delay or a fourth amount of delay to modulated optical signals passing therethrough, and wherein at least one of said second delay units is connected in series to at least two of the first delay units.

2. Beam steering apparatus according to claim 1, wherein each of said optical carriers has a predetermined wavelength that is different in respect of each antenna element.

3. Beam steering apparatus according to claim 2, wherein said demultiplexing means comprise a wavelength division demultiplexer.

4. Beam steering apparatus according to claim 1, wherein a first difference, between the first and second amounts of delay, is different from a second difference, between the third and fourth amounts of delay.

5. Beam steering apparatus according to claim 4, wherein the said second difference of delay is greater than the said first difference.

6. Beam steering apparatus according to claim 1, further comprising optical combining means arranged to combine the modulated optical signals modified by said at least two of the first delay units.

7. Beam steering apparatus according to claim 6, wherein the optical combining means are arranged to combine the modulated optical signals delayed by said at least two of the first delay units and to output the combined signal into a single optical waveguide for input to said at least one of said second delay units.

8. Beam steering apparatus according to claim 1, wherein each of said first and second delay units comprise an opto-electrical switching device arranged to selectively apply respective said amounts of delay to a modulated optical carrier passing therethrough.

9. Beam steering apparatus according to claim 1, wherein the antenna elements are spatially arranged so as to form a linear array.

10. Beam steering apparatus according to claim 1, wherein the antenna elements are spatially arranged so as to form a circular array.

11. Beam steering apparatus according to claim 1, wherein the antenna elements are spatially arranged so as to form a planar array.

12. A method for combining signals received by antenna elements of an antenna array, the antenna array having a plurality of said antenna elements arranged spatially with respect to one another, the method comprising the steps of:

(i) for each antenna element of the array, modulating a signal received by the antenna element onto a different respective optical carrier, each said optical carrier having a different wavelength;

(ii) passing each of the modulated optical signals through first delaying means comprising a plurality of first delay units, a different one of said plurality of first delay units being provided in respect of each antenna element to apply selectively either a first or a second amount of delay to the respective modulated optical signal passing therethrough;

(iii) passing the modulated optical signals delayed by said first delaying means through second delaying means comprising a plurality of second delay units, wherein at least one of said second delay units is linked to at least two of said first delay units and the modulated optical signals output by said at least two of said first delay units are collected into the same optical waveguide for input to said at least one of said second delay units, each said second delay unit being arranged to apply selectively either a third or a fourth amount of delay to optical signals passing therethrough;

(iv) separating the delayed modulated optical carriers, output by the second delaying means, in a demultiplexer;

(v) demodulating the signal received by each of said antenna elements from the respective separated delayed modulated optical carrier; and (vi) combining the demodulated signals to output a combined signal as received by the antenna array.

13. A method according to claim 12, wherein a first difference, between the first and second amounts of delay, is different to a second difference, between the third and fourth amounts of delay.

14. A method according to claim 13, wherein said second difference is greater than the said first difference.

15. Beam steering apparatus comprising:

an antenna array having a plurality of antenna elements, the antenna elements being spatially arranged with respect to one another and being operable to receive signals;

signal modulating means comprising a plurality of optical modulators, each of which is associated with a different one of the antenna elements and operable to modulate signals received thereby onto a different respective optical carrier;

delay means arranged to apply an amount of delay to modulated optical signals passing therethrough in respect of one or more of the antenna elements;

demultiplexing means operable to separate the modulated optical carriers within an optical signal output by the delay means;

demodulating means operable to demodulate the signal received by each antenna element from the respective separated modulated optical carrier; and combining means operable to combine the demodulated received signals output by the demodulating means, wherein the delay means comprise:

a plurality of first delay units, each of which is associated with a different one of the antenna elements and is operable to apply selectively either a first amount of delay or a second amount of delay to the respective modulated optical signal passing therethrough; and a plurality of second delay units, each of which is linked in series to at least one of the first delay units and is operable to apply selectively either a third amount of delay or a fourth amount of delay to modulated optical signals passing therethrough, wherein at least one of said second delay units is connected in series to at least two of the first delay units, wherein each of said optical carriers has a predetermined wavelength that is different in respect of each antenna element.

16. Beam steering apparatus according to claim 15, wherein said demultiplexing means comprises a wavelength division demultiplexer.

* * * * *